US009415421B2

(12) United States Patent
Kozawa et al.

(10) Patent No.: US 9,415,421 B2
(45) Date of Patent: Aug. 16, 2016

(54) POWDER CLASSIFYING DEVICE

(75) Inventors: Kazumi Kozawa, Fujimino (JP); Kosuke Ando, Fujimino (JP); Harutoshi Tominaga, Fujimino (JP); Masaru Kyugo, Fujimino (JP); Daisuke Sato, Fujimino (JP)

(73) Assignee: NISSHIN SEIFUN GROUP INC., Tokyo (JP)

( * ) Notice: Subject to any disclaimer, the term of this patent is extended or adjusted under 35 U.S.C. 154(b) by 182 days.

(21) Appl. No.: 13/885,589

(22) PCT Filed: Oct. 14, 2011

(86) PCT No.: PCT/JP2011/073635

§ 371 (c)(1),
(2), (4) Date: May 15, 2013

(87) PCT Pub. No.: WO2012/066885

PCT Pub. Date: May 24, 2012

(65) Prior Publication Data

US 2014/0021109 A1 Jan. 23, 2014

(30) Foreign Application Priority Data

Nov. 16, 2010 (JP) ..... 2010-256053

(51) Int. Cl.
*B04B 5/10* (2006.01)
*B07B 7/083* (2006.01)
(Continued)

(52) U.S. Cl.
CPC . *B07B 7/083* (2013.01); *B07B 7/08* (2013.01); *B07B 11/04* (2013.01); *B07B 11/06* (2013.01)

(58) Field of Classification Search
CPC ..... B02C 23/10; B07B 4/02; B07B 7/10; B07B 7/08; B07B 7/083; B07B 11/04; B07B 11/06
USPC ..... 209/138, 139.1, 139.2, 143, 154, 710, 209/717, 718, 722
See application file for complete search history.

(56) References Cited

U.S. PATENT DOCUMENTS 4,545,897 A * 10/1985 Masuda ..... 209/135
4,743,363 A * 5/1988 Darrow ..... 209/138
(Continued)

FOREIGN PATENT DOCUMENTS

JP 50-55971 A 5/1975
JP 05-049973 A 3/1993
(Continued)

*Primary Examiner* — Joseph C Rodriguez
*Assistant Examiner* — Kalyanavenkateshware Kumar
(74) *Attorney, Agent, or Firm* — Muncy, Geissler, Olds & Lowe, P.C.

(57) ABSTRACT

A powder classifying device includes a plurality of powder classifiers that impart a whirling motion to powder with whirling gas streams to classify the powder into coarse powder and fine powder, a gas supply source that supplies the plurality of powder classifiers with gas for generating the whirling gas stream, a powder supplier that supplies the plurality of powder classifiers with powder having a particle size distribution, a fine powder collecting section that collects fine powder classified by each of the plurality of powder classifiers, a coarse powder recovery section that recovers coarse powder classified by each of the plurality of powder classifiers, and a controller that controls flow rates of gases supplied to the plurality of powder classifiers so that a classification point is substantially equal among the plurality of powder classifiers.

7 Claims, 4 Drawing Sheets

(51) Int. Cl.

| | |
|---|---|
| ***B07B 7/08*** | (2006.01) |
| ***B07B 11/04*** | (2006.01) |
| ***B07B 11/06*** | (2006.01) |

(56) References Cited

U.S. PATENT DOCUMENTS

| | | | | |
|---|---|---|---|---|
| 6,276,534 | B1 * | 8/2001 | Huang et al. | 209/139.2 |
| 8,100,269 | B2 | 1/2012 | Taketomi et al. | |
| 2006/0163134 | A1 | 7/2006 | Shimamura et al. | |
| 2009/0032443 | A1 * | 2/2009 | Taketomi et al. | 209/135 |

FOREIGN PATENT DOCUMENTS

| | | | |
|---|---|---|---|
| JP | 6-83818 | B | 10/1994 |
| JP | 07-163909 | A | 6/1995 |
| JP | 8-57424 | A | 3/1996 |
| JP | 10-263439 | A | 10/1998 |
| JP | 11-138103 | | 5/1999 |
| JP | 2003-126726 | A1 | 5/2003 |
| JP | 2007-296451 | A | 11/2007 |
| JP | 2009-34560 | A | 2/2009 |
| JP | 2009-189965 | A | 8/2009 |
| WO | WO2006/078012 | A1 | 7/2006 |

* cited by examiner

FIG.2
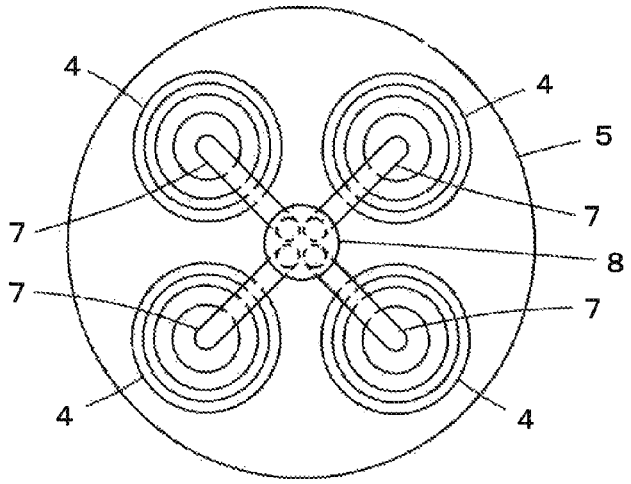
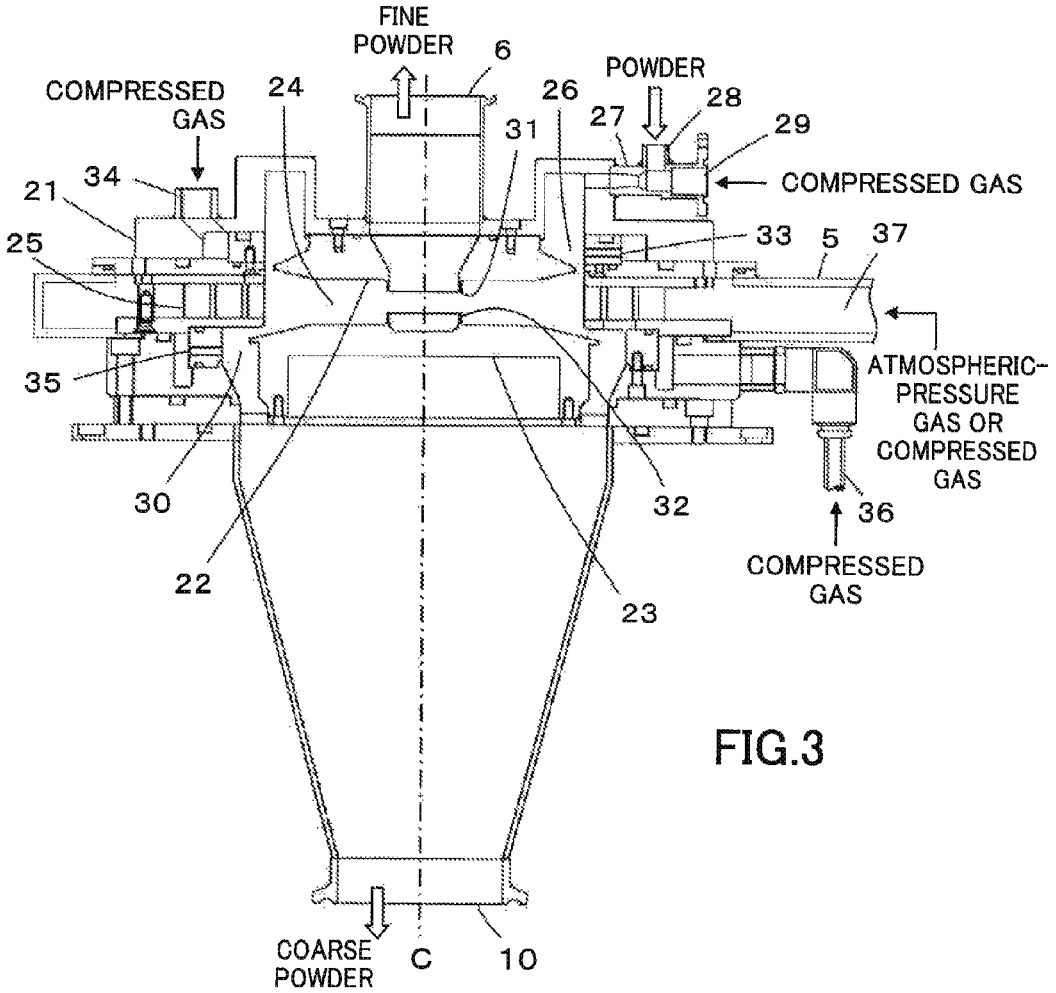
FIG.3

POWDER CLASSIFYING DEVICE

TECHNICAL FIELD

The present invention relates to a powder classifying device that classifies powder having a particle size distribution at a desired classification point and, in particular, to a powder classifying device that classifies a large amount of powder using a balance between a centrifugal force imparted to the powder by a whirling gas stream and a drag force generated by a gas stream.

BACKGROUND ART

There is known in the art a classifying device that uses guide vanes to generate a whirling gas stream, which imparts a whirling motion to powder, and centrifuges the powder into fine particles and coarse particles.

In a powder classifying device proposed in Patent Literature 1, for example, there are provided near the lower end of a cone-shaped powder passage a plurality of guide vanes disposed in upper and lower annular stages separated by a partition board. Exhaust air is discharged from an exhaust pipe, generating air circulation passing through the guide vanes. Powder that passes through the cone-shaped powder passage and falls into spaces between the upper guide vanes are caused to gyrate, so that the powder is classified according to the relationship between centrifugal force and drag.

Patent Literature 2 describes a material supply device in which guide vanes are disposed in an annular arrangement around a material supply cylinder and powder material supplied into the material supply cylinder is dispersed by introducing air from the outside through secondary air inlet passages between adjacent guide vanes. Air stream generated by suction and discharge through a discharge pipe causes the material to whirl at high speed in dispersion as it falls down the material supply cylinder, flows into a classifying chamber, and is therein centrifuged into coarse powder and fine powder.

Patent Literature 3 describes a stream-type classifying device comprising guide vanes disposed around a classifying chamber in an annular arrangement and air stream inlet passages provided between adjacent guide vanes, wherein powder supplied into the classifying chamber is caused to whirl at high speed by air suction and discharge through an exhaust pipe and centrifuged into fine powder and coarse powder.

CITATION LIST

Patent Literature

Patent Literature 1: JP 06-83818 B
Patent Literature 2: JP 08-57424 A
Patent Literature 3: JP 11-138103 A

SUMMARY OF INVENTION

Technical Problems

Such classifying devices using guide vanes generate a whirling air stream by causing air to pass through the guide vanes by suction and discharge through the discharge pipe using, for example, a blower to impart a whirling motion to the powder thereby to centrifuge the powder into coarse powder and fine powder.

However, in a powder classifying device that achieves classification of powder using the balance between centrifugal force imparted to the powder by a whirling air stream and drag force generated by gas flow, increasing the dimensions of the device and enlarging the volume of the classifying chamber in order to improve the processing capability increases the radial velocity of powder, which changes the classification point to a greater value, making classification into fine particles such as sub-micron powder difficult. This limited the processing capability for classification of fine particles.

It is an object of the present invention to solve the above conventional problems and provide a powder classifying device capable of classifying powder into fine particles with a high processing capability.

Solution to Problems

A powder classifying device of the invention comprises a plurality of powder classifiers that impart a whirling motion to powder with whirling gas streams to classify the powder into coarse powder and fine powder, a gas supply source that supplies the plurality of powder classifiers with gas for generating the whirling gas stream, a powder supplier that supplies the plurality of powder classifiers with powder having a particle size distribution, a fine powder collecting section that collects fine powder classified by each of the plurality of powder classifiers, a coarse powder collecting section that recovers coarse powder classified by each of the plurality of powder classifiers, and a controller that controls flow rates of gases supplied to the plurality of powder classifiers so that a classification point is substantially equal among the plurality of powder classifiers.

Preferably, each of the plurality of powder classifiers comprises: a casing including inside thereof a substantially disk-shaped centrifuge chamber; an annular powder dispersion chamber located on one side of the centrifuge chamber, disposed concentric with the centrifuge chamber, and communicating with the centrifuge chamber; and an annular powder re-classifying chamber located on another side of the centrifuge chamber, disposed concentric with the centrifuge chamber, and communicating with the centrifuge chamber; a plurality of guide vanes disposed so as to inwardly extend from an outer periphery of the centrifuge chamber at a given angle and adapted to cause gas to flow into the centrifuge chamber or a plurality of gas supply nozzles disposed at a given angle around the centrifuge chamber and adapted to supply gas into the centrifuge chamber; and a plurality of first nozzles that elect gas into the powder dispersion chamber to generate the whirling gas stream.

Each of the plurality of powder classifiers may comprise a plurality of second nozzles that eject gas into the powder re-classifying chamber to generate the whirling gas stream.

Preferably, the controller controls flow rates of gases admitted through the guide vanes of the plurality of powder classifiers or either of pressures and flow rates of gases supplied from the gas supply source to the plurality of powder classifiers so that pressure losses in the plurality of powder classifiers are substantially equal to each other.

The powder supplier may comprise a powder distributor that distributes powder to the plurality of powder classifiers. The powder supplier may comprise an ejector provided inside the casing so as to communicate with the powder dispersion chamber and adapted to supply powder into the powder dispersion chamber, and further the powder supplier may comprise both a powder distributor and an ejector.

Preferably, each of the plurality of powder classifiers comprises a fine powder outlet that discharges gas streams containing fine powder, and the fine powder collecting section comprises a common collector connected to the fine powder outlets of the plurality of powder classifiers.

Each of the plurality of powder classifiers may comprise a coarse powder outlet that discharges coarse powder; the coarse powder collecting section may comprise a plurality of dumpers connected to the coarse powder outlets of the plurality of powder classifiers, respectively, and a common collecting container connected to the plurality of dumpers. Alternatively, each of the plurality of powder classifiers may comprise a coarse powder outlet that discharges coarse powder, and the coarse powder collecting section may comprise a plurality of collecting containers connected to the coarse powder outlets of the plurality of powder classifiers.

Advantageous Effects of Invention

According to the present invention, the controller controls flow rates of gases admitted through the guide vanes of the plurality of powder classifiers or either of pressures and flow rates of gases supplied from the gas supply source to the plurality of powder classifiers so that classification points in the plurality of powder classifiers are substantially equal to each other, achieving classification of fine particles with a high processing capability using a plurality of powder classifiers.

BRIEF DESCRIPTION OF DRAWINGS

FIG. 2 is a plan view of a powder classifying device body used in the embodiment.

FIG. 3 is a cross section illustrating an inner structure of a powder classifier used in the embodiment.

DESCRIPTION OF EMBODIMENTS

The present invention is described in detail below based on the preferred embodiments illustrated in the accompanying drawings.

Figure 1:
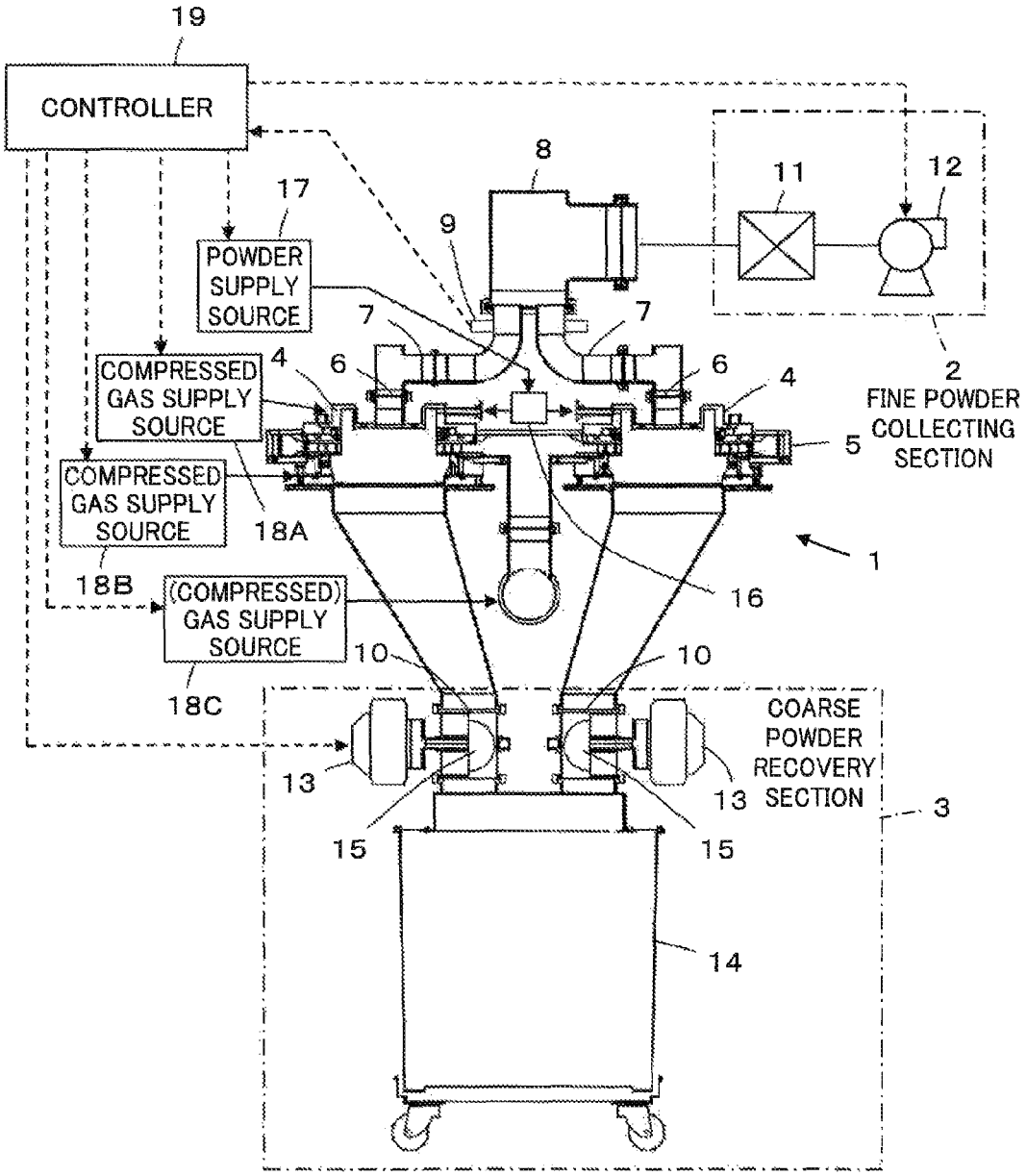
FIG. 1 illustrates a configuration of a powder classifying device according to an embodiment of the invention.

FIG. 1 illustrates a configuration of a powder classifying device according to an embodiment of the invention. The powder classifying device comprises a classifying device body s that classifies powder, a fine powder collecting section 2 and a coarse powder collecting section 3 connected to the classifying device body 1.

The classifying device body 1 comprises powder classifiers 4 each of which imparts a whirling motion to powder by virtue of a whirling gas stream and thereby classifies the powder into coarse powder and fine powder. The powder classifiers 4 are connected to each other by a hollow, substantially disk-shaped connecting member 5. The powder classifiers 4 each have a fine powder outlet 6, which is connected to a junction pipe 8 through a fine powder discharge pipe 7. The junction pipe 8 is connected to the fine powder collecting section 2. Each fine powder discharge pipe 7 has a pressure sensor 9 that detects the outlet pressure of the corresponding powder classifier 4. The powder classifiers 4 each have a coarse powder outlet 10, which is connected to the coarse powder collecting section 3.

The fine powder collecting section 2 comprises a collector 11, such as a bag filter, which is connected to the junction pipe 8 of the classifying device body 1, and a suction blower 12 connected to the collector 11.

The coarse powder collecting section 3 comprises dumpers 13 connected to the respective coarse powder outlets 10 of the powder classifiers 4 and a common collecting container 14 connected to the dumpers 13. The dumpers 13, equipped with air-tight, rotatable valve plates 15, intermittently discharge into the collecting container 14 the coarse powder remaining in the coarse powder outlets 10 of the respective powder classifiers 4.

The powder classifiers 4 of the classifying device body 1 are connected to a powder supply source 17 through a powder distributor 16. The powder supply source 17 supplies powder that is to be classified in the powder classifying device according to this embodiment and which has a particle size distribution. The powder distributor 16 distributes the powder introduced from the powder supply source 17 evenly among the powder classifiers 4.

The powder classifiers 4 of the classifying device body 1 are connected to compressed gas supply sources 18A and 186 that supply compressed gas and a (compressed) gas supply source 18C that supplies gas or compressed gas.

The pressure sensors 9 of the classifying device body 1 are connected to a controller 19, which is connected to the suction blower 12 of the fine powder collecting section 2, the dumpers 13 of the coarse powder collecting section 3, the powder supply source 17, the compressed gas supply sources 18A, 18B, and the gas supply source 18C.

As illustrated in FIG. 2, the classifying device body 1 comprises four powder classifiers 4. The powder classifiers 4 have the same inner structure.

As illustrated in FIG. 3, there are provided in an upper position inside a casing 21 an upper disk-like member 22 and a lower disk-like member 23 positioned on a center axis C, one disposed opposite the other and separated by a given distance. Between the disk-like members 22 and 23 is defined a substantially disk-shaped centrifuge chamber 24, around which are provided guide vanes 25 extending inwardly at a given angle. The guide vanes 25 are mounted on a rotary axis parallel to the central axis C so as to rotate between the upper disk-like member 22 and the lower disk-like member 23. The vane opening angle of all the guide vanes 25 can be changed simultaneously by turning a rotary plate, not shown, to adjust the distance between adjacent guide vanes 25.

In place of the guide vanes 25 disposed around the centrifuge chamber 24, there may alternatively be provided around the centrifuge chamber 24 gas supply nozzles disposed at a given angle and connected to the gas supply source 18C, so that the gas supply source 18C supplies gas into the centrifuge chamber 24 through the gas supply nozzles.

The casing 21 includes therein an annular powder dispersion chamber 26 defined around the centrifuge chamber 24 and disposed concentric with the centrifuge chamber 24. The powder dispersion chamber 26 communicates with the centrifuge chamber 24. In FIG. 3, there is provided an ejector 27 directed toward the powder dispersion chamber 26. The ejector 27 has a powder inlet 28 and a compressed gas inlet 29. The powder inlet 28 is connected to the powder distributor 16; the compressed gas inlet 29 is connected to a compressed gas supply source, not shown, for the ejector.

Around the lower disk-like member 23, there is defined an annular powder re-classifying chamber 30 along the outer periphery of the centrifuge chamber 24 and concentric with the centrifuge chamber 24. The powder re-classifying chamber 30 communicates with the centrifuge chamber 24.

The upper disk-like member 22 is connected to the fine powder outlet 6 opening toward the center of the centrifuge chamber 24. The casing 21 has at its lower end the coarse powder outlet 10 communicating with the centrifuge chamber 24 through the powder re-classifying chamber 30.

The upper disk-like member 22 has an annular edge portion 31 provided on the outer periphery of an opening, which communicates with the fine powder outlet 6, and projecting toward the centrifuge chamber 24; the lower disk-like member 23 has near its center and opposite the edge portion 31 an annular edge portion 32 projecting toward the centrifuge chamber 24. Thus, the edge portions 31 and 32 are disposed on the opposite sides of the centrifuge chamber 24.

In the peripheral wall defining the powder dispersion chamber 26, first nozzles 33 are arranged so as to oppose the inside of the powder dispersion chamber 26 and connected to the compressed gas supply source 18A through a compressed gas inlet 34. In the peripheral wall defining the powder re-classifying chamber 30, second nozzles 35 are disposed so as to oppose the inside of the re-classifying chamber 30 and connected to the compressed gas supply source 16B through a compressed gas inlet 36.

The first nozzles 33 are disposed at a given angle to a tangent to the annular powder dispersion chamber 26 and, likewise, the second nozzles 35 are disposed at a given angle to a tangent to the annular powder re-classifying chamber 30. In such configuration, ejection of compressed gas from the first nozzles 33 or the first nozzles 33 and they second nozzles 35 causes whirling gas streams to be generated in the powder dispersion chamber 26 and the powder re-classifying chamber 30 that whirl in the same direction.

Around the outer periphery of the guide vanes 25, which in turn are disposed around the centrifuge chamber 24, there is located a compressed as forcing chamber 37 defined inside a hollow connecting member 5 and connected to the compressed gas supply source 18C. In the above configuration, forcing compressed gas via the compressed gas forcing chamber 37 through the guide vanes 25 into the centrifuge chamber 24 causes a whirling gas stream to be generated in the centrifuge chamber 24 in the same direction as the whirling gas streams generated in the powder dispersion chamber 26 and the powder re-classifying chamber 30.

Instead of forcibly introducing compressed gas, a gas at the atmospheric pressure may be allowed to flow through the guide vanes 25 into the centrifuge chamber 24.

As described above, a whirling gas stream may be allowed to be generated in the centrifuge chamber 24 in the same direction as the whirling gas streams generated in the powder dispersion chamber 26 and the powder re-classifying chamber 30 by ejecting compressed gas from the gas supply nozzles disposed at a given angle around the centrifuge chamber 24, instead of disposing the guide vanes 25.

Next, the operation of the powder classifying device according to this embodiment is described below.

The valve plate 15 of each of the dumpers 13 of the coarse powder collecting section 3 needs to have been previously closed by the controller 19.

First, the controller 19 operate the suction blower 12 of the fine powder collecting section 2, whereupon a given amount of blown air is sucked into the centrifuge chamber 24 through the fine powder outlet 6 in each of the powder classifiers 4, while the compressed gas supply sources 18A and 18B supply compressed gas to the compressed gas inlets 34 and 36 of each of the powder classifiers 4 for the first nozzles 33 and the second nozzles 35 to elect the compressed gas, and the compressed gas supply source 18C supplies compressed gas to the compressed gas forcing chamber 37 of the connecting member 5, so that the compressed gas is forcibly introduced through the guide vanes 25 of each of the powder classifiers 4. Thus, whirling gas streams whirling in the same direction are generated in the powder dispersion chamber 26, the centrifuge chamber 24, and the powder re-classifying chamber 30 of each of the powder classifiers 4.

In this state, the compressed gas is supplied from the compressed gas supply source (not shown) for the ejector to the compressed gas inlet 29 of the ejector 27 of each of the powder classifiers 4, while powder is evenly distributed and supplied through the powder distributor 16 from the powder supply source 17 to the powder inlet 28 of the ejector 27 of each of the powder classifiers 4, whereupon the powder is caused to enter the powder dispersion chamber 26 at a given flow rate by the compressed gas supplied through the compressed gas inlet 29, where the powder, exposed to a whirling gas stream, is subjected to a whirling motion and is dispersed as it is allowed to fall through an annular gap formed around the upper disk-like member 22 into the centrifuge chamber 24.

Because a whirling gas stream is also generated inside the centrifuge chamber 24, the powder falling in from the powder dispersion chamber 26 is caused to whirl inside the centrifuge chamber 24 and thereby subjected to centrifugation. As a result, fine powder having a size not larger than a classification point (a particle cut size) is sucked and discharged together with the gas stream through the fine powder outlets 6, while coarse powder having a large particle size is caused to remain by the annular edge portions 31 and 33 provided in the central portion of the centrifuge chamber 24. Thus, fine powder can be sorted from powder having a particle size distribution and collected. The thus sorted fine powder scarcely contains coarse powder having a particle size larger than a classification point.

Thus, the fine powder discharged through the fine powder outlet 6 of each of the powder classifiers 4 passes through the fine powder discharge pipe 7 to reach the junction pipe 8, where the fine powder discharged from the four powder classifiers 4 joins and is collected in the collector 11 of the fine powder collecting section 2.

A detection signal sent from the pressure sensor 9 provided at the fine powder discharge pipe 7 of each of the powder classifiers 4 enters the controller 19.

The remainder of the powder not discharged from the fine powder outlet 6 in each of the powder classifiers 4 is allowed to fall through an annular gap located around the lower disk-like member 23 from the centrifuge chamber 24 into the powder re-classifying chamber 30. Accordingly, the powder allowed to fall into the powder re-classifying chamber 30 may often contain not only coarse powder larger than a classification point but fine powder not larger than a classification point. However, because the powder re-classifying chamber 30 contains a whirling gas stream generated by the compressed gas ejected from the second nozzles 35, the fine powder is carried by the whirling gas stream back into the centrifuge chamber 24. Thus, the fine powder is efficiently removed from the coarse powder and discharged from the fine powder outlet 6.

After undergoing such re-classification in the powder re-classifying chamber 30, coarse powder larger than a classification point is allowed to fall from the powder re-classifying chamber 30 down to the coarse powder outlet 10.

As the coarse powder thus falls down to the coarse powder outlet 10 of each of the powder classifiers 4, the valve plate 15 of the dumper 13 connected to the coarse powder outlet 10 of each and every powder classifiers 4 is closed and thus prevents the coarse powder from being discharged into the collecting container 14.

Should the valve plates 15 of all the dumpers 13 be opened simultaneously, gas might circulate between the powder classifiers 4 through the dumpers 13 and the collecting container 14, possibly disturbing the whirling gas streams generated inside the powder classifiers 4. This might reduce classification accuracy.

Therefore, the controller 19 operates only one of the dumpers 13 and keeps the valve plate 15 thereof open for a given period of time to allow the coarse powder classified by the powder classifier 4 connected to said dumper 13 to be discharged into the collecting container 14. Upon elapse of the given period of time, the valve plate 15 of the dumper 13 is closed again, whereupon the valve plate 15 of the next dumper 13 is opened for the given period of time. Thus, the coarse powder classified by the powder classifier 4 connected to the next dumper 13 is discharged into the collecting container 14. The valve plates 15 of the dumpers 13 are likewise sequentially opened one at a time to discharge coarse powder into the collecting container 14.

Thus opening the valve plates 15 of the dumpers 13 sequentially one at a time instead of opening the valve plates 15 of the dumpers 13 all simultaneously enables collecting of coarse powder in the collecting container 14 without reducing the classification accuracy. Each of the dumpers 13 may be, for example, a device such as a shutter having an opening and closing structure, provided that the device can be so controlled as described above.

While the four powder classifiers 4 implement powder classification as described above, the controller 19 calculates pressure losses in the powder classifiers 4 based on detection signals sent from the pressure sensors 9 provided at the respective fine powder discharge pipes 7 of the powder classifiers 4. The pressures and/or the flow rates of the gases supplied from the compressed gas supply sources 18A, 18B and the gas supply source 180 to the powder classifiers 4 are controlled so that the calculated pressure losses in the four powder classifiers 4 are equal. The supply of gases from the compressed gas supply sources 18A, 18B and the gas supply source 18C to the ejector 27, the compressed gas forcing chamber 37, the gas supply nozzles provided around the centrifuge chamber 24, the first nozzles 33, and the second nozzles 35 can be adjusted individually as can the pressures and the flow rates of the ejected gases. Some of these may be controlled and the others may be kept constant. Control of the pressure and/or flow rate at the first nozzles 33 is particularly important in the adjustment of the classification point.

In a classifying device that classifies powder into coarse powder and fine powder by generating a whirling gas stream and imparting a whirling motion to the powder by virtue of the whirling gas stream, typically, the classification point depends on the intensity of the whirling gas stream, and the intensity of the whirling gas stream is correlated with the pressure loss in the classifier, when the dimensions of the classifier are identical. Therefore, when the pressure losses in the four powder classifiers 4 are adjusted to be equal, the intensities of the whirling gas streams generated inside the respective powder classifiers 4 are equal, and the classification points in the powder classifiers 4 can be equalized. As a result, a high-accuracy classification is achieved even when the four powder classifiers 4 are operated in parallel to increase the processing capability.

More specifically, the pressure losses in the four powder classifiers 4 can be equalized by adjusting the pressures at the first nozzles 33 or the first nozzles and the second nozzles 35 of the powder classifiers 4 or by adjusting the flow rates of the compressed gases ejected from the first nozzles 33 or the first nozzles 33 and the second nozzles 35 of the powder classifiers 4 with flow rate adjusters, such as flow rate adjusting valves, to be provided between the compressed gas supply sources 18A, 18E and the compressed gas inlets 34, 36 of the respective powder classifiers 4.

Alternatively, the pressure losses in the four powder classifiers 4 can be equalized by adapting the controller 19 to change the vane opening angle of the guide vanes 25 in the powder classifiers 4 so as to adjust the flow rates of the gases forced into the centrifuge chambers 24 of the powder classifiers 4.

Alternatively, the pressure losses in the four powder classifiers 4 can be equalized by adjusting the flow rates of the compressed gases flowing into the powder classifiers 4 using flow rate adjusters provided between the compressed gas supply source, not shown, and the compressed gas inlets 29 of the ejectors 27 of the powder classifiers 4. In this case, however, changing the flow rates of the compressed gases admitted through the compressed gas inlets 29 of the ejectors 27 may change the amounts of supplied powder from the powder supply source 17 to the powder classifiers 4.

Figure 4:
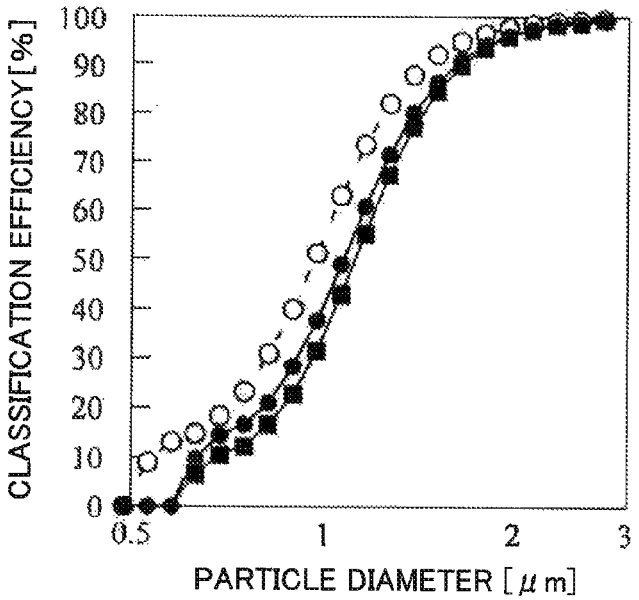
FIG. 4 is a graph showing a relationship between particle diameter and classification efficiency when the nozzle manufacturing dimensions vary.

Further, even where the four powder classifiers 4 used have the same structure, there may arise a variation in the classification point among the powder classifiers due to, for example, variations in dimensions among component parts caused by manufacturing tolerances. For example, FIG. 4 illustrates classification efficiency in relation to particle diameter as the diameter of the first nozzles 33 change. In the graph, black squares indicate the classification efficiency obtained with a nozzle diameter of 1.3 mm, a gas pressure of 0.6 MPa, and a gas flow rate of 626 liters/min; and white circles indicate the classification efficiency obtained a nozzle diameter of 1.4 mm, a gas pressure of 0.6 MPa, and a gas flow rate of 739 liters/min. The graph shows that with the same gas pressure, the classification point varies greatly as the nozzle diameter and the gas flow rate change.

The classification efficiency indicated by black circles in the graph was obtained with a nozzle diameter of 1.4 mm, a gas pressure of 0.48 MPa, and a gas flow rate of 619 liters min. Even when the nozzle diameter changes from 1.3 mm to 1.4 mm, the classification point can be brought close to that resulting from the use of nozzles having a diameter of 1.3 mm indicated by the black squares through adjustment of the gas pressure and the gas flow rate.

Thus, even where the manufacturing dimensions vary, the classification accuracy can be enhanced by adjusting the flow rates of the gases supplied from the compressed gas supply sources 18A, 18B and the gas supply source 18C to the powder classifiers 4.

Now, in the embodiment of the powder classifying device, powder in a total amount of 8 kg/h was classified by supplying powder at a flow rate of 2 kg/h to each of the four powder classifiers 4 connected to each other, and a classification accuracy index κ was measured for various classification points. The result is indicated by white circles in FIG. 5. For comparison, black circles indicate measurements obtained when only one powder classifier 4 was used to classify powder supplied at a flow rate of 2 kg/h, and black squares indicate measurements obtained when only one powder classifier 4 was used to classify powder supplied at a flow rate of 8 kg/h.

Figure 5:
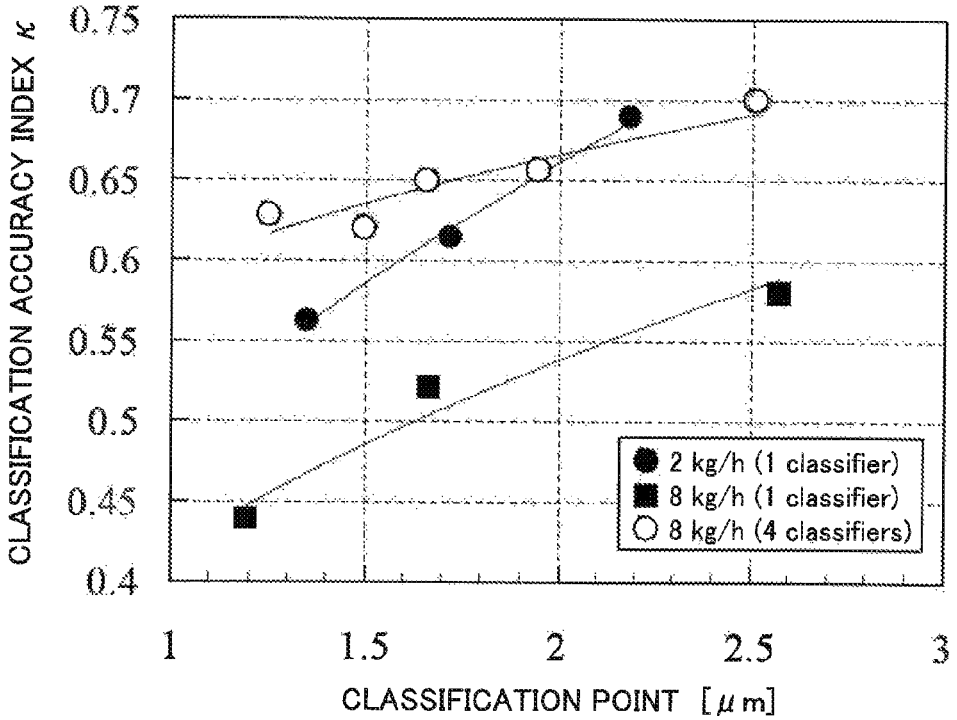
FIG. 5 is a graph showing a relationship between classification point and classification accuracy index in the embodiment.

The classification accuracy index κ is expressed as a ratio of 25% cut size D25 to 75% cut size D75. That is, $\kappa = D25/D75$ As shown by FIG. 5, a higher classification accuracy is achieved using the powder classifying device according to the embodiment wherein the four powder classifiers 4 are connected to classify powder at a flow rate of 8 kg/h than when only one powder classifier 4 is used to classify powder supplied at a flow rate of 8 kg/h.

In the powder classifying device according to the embodiment, the controller 19 controls the flow rates of the gases supplied from the compressed gas supply sources 181, 18E and the gas supply source 18C to each of the powder classifiers 4 so as to generate stable whirling gas streams in the powder classifiers 4, enabling a high-accuracy classification of sub-micron particles having a diameter smaller than, for example, 1 μm.

Powders that can be classified by the present invention range from low specific-gravity powders such as powders of silica and toners to high specific-gravity powders such as powders of metals and alumina.

Gases supplied from the compressed gas supply sources 18A, 18B and the gas supply source 180 may be compressed air or, depending on the powder to be classified, inactive gas, for example.

The powder distributor 16 that distributes powder from the powder supply source 17 to the powder classifiers 4 may be any distributor known in the art such as, for example, a distributor of a type that distributes powder using whirling gas streams. Use of the powder distributor 16 is not essential. For example, a hopper may be connected to the powder inlet 28 of the ejector 27 of each of the powder classifiers 4 to store powder in the hopper, and powder therein may be supplied by means of the ejector 27.

In the above embodiment, circulation of gases between the powder classifiers 4 is prevented by opening the valve plates 15 of the dumpers 13 sequentially one at a time. Connection of a so-called double-dumper, which, equipped with a pair of serially disposed valve plates, can discharge powder while maintaining airtightness, to the coarse powder outlet 10 of each of the powder classifiers 4 enables simultaneous discharge of coarse powder from a plurality of powder classifiers 4 while preventing gas circulation between the powder classifiers 4.

Figure 6:
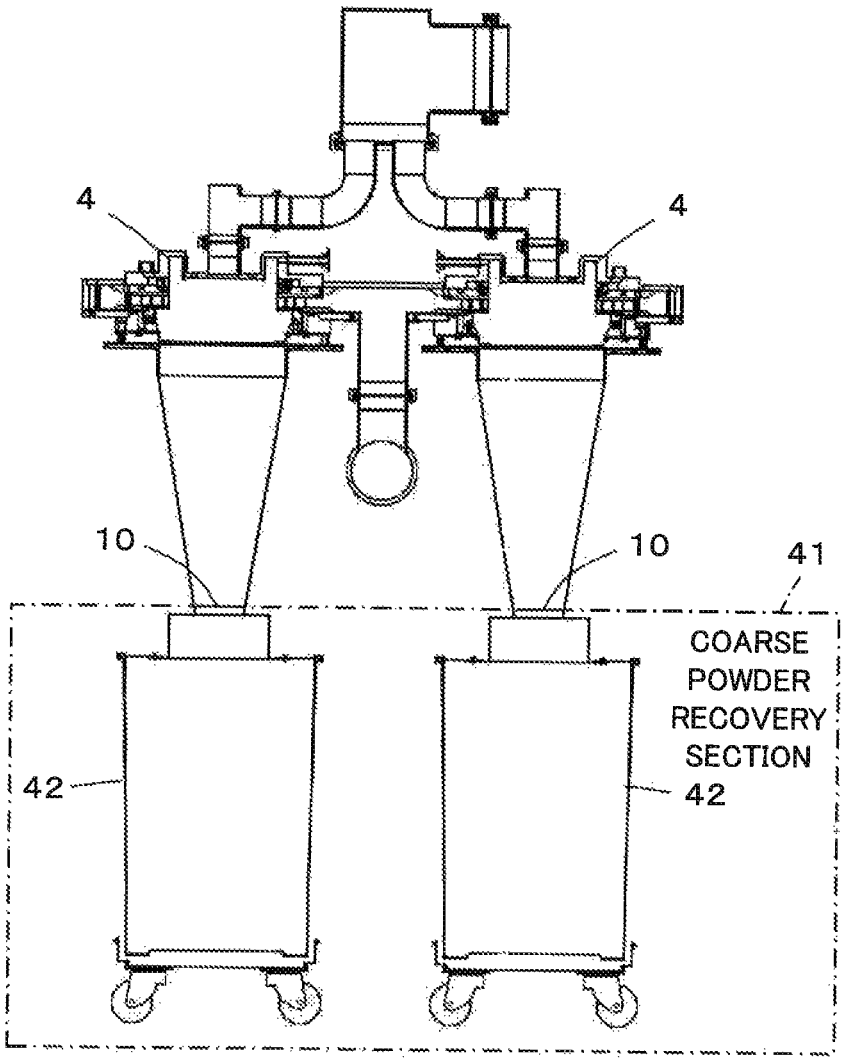
FIG. 6 is a front view of the powder classifying device and a coarse powder collecting section used in another embodiment.

A coarse powder collecting section 41 as illustrated in FIG. 6 may also be used. Using the coarse powder collecting section 41, dedicated collecting containers 42 are connected to the respective coarse powder outlets 10 of the powder classifiers 4 without the intermediary of dumpers.

In such a configuration, where four separate collecting containers 42 are provided individually for the respective four powder classifiers 4, as circulation between the powder classifiers 4 through a common collecting container never occurs. Therefore, simultaneous discharge of coarse powder from a plurality of powder classifiers 4 is made possible without reducing the classification accuracy.

While four powder classifiers 4 are connected to each other in the above embodiment, the number of powder classifiers is not limited to four and may be 2, 3, 5 or more units thereof may be connected.

While the annular edge portions 31 and 32 are disposed on the opposite sides of the centrifuge chamber 24 in each of the powder classifiers 4 in the above embodiment, only one of the edge portions 31 and 32 may be provided.

While the powder classifiers 4 in the above embodiment use both the first nozzles 33 provided so as to oppose the inside of the powder dispersion chamber 26 and the second nozzles 35 provided so as to oppose the inside of the powder re-classifying chamber 30, the second nozzles 35, for example, may be omitted.

Instead of using the guide vanes 25, use may be made of a powder classifier in which the centrifuge chamber 24 is closed on the outer peripheral side thereof by a peripheral wall member.

REFERENCE SIGNS LIST

1 classifying device body; 2 fine powder collecting section; 3, 41 coarse powder collecting section; 4 powder classifier; 5 connecting member; 6 fine powder outlet; 7 fine powder discharge pipe; 8 junction pipe; 9 pressure sensor; 10 coarse powder outlet; 11 collector; 12 suction blower; 13 dumper; 14, 42 collecting container; 15 valve plate; 16 powder distributor; 17 powder supply source; 18A, 18B compressed gas supply source; 18C gas supply source; 19 controller; 21 casing; 22 upper disk-like member; 23 lower disk-like member; 24 centrifuge chamber; 25 guide vanes; 26 powder dispersion chamber; 27 ejector; 28 powder inlet; 29, 34, 36 compressed gas inlet; 30 powder re-classifying chamber; 31, 32 edge portion; 33 first nozzle; 35 second nozzle; 37 compressed gas forcing chamber.

The invention claimed is:

1. A powder classifying device comprising:

a plurality of powder classifiers that impart a whirling motion to powder with whirling gas streams to classify the powder into coarse powder and fine powder, each of the plurality of powder classifiers including a coarse powder outlet that discharges coarse powder, a gas supply source that supplies the plurality of powder classifiers with gas for generating the whirling gas stream, a powder supplier that supplies the plurality of powder classifiers with powder having a particle size distribution, a fine powder collecting section that collects fine powder classified by each of the plurality of powder classifiers, a plurality of dumpers corresponding to the plurality of powder classifiers, each dumper being connected to the coarse powder outlet of the corresponding powder classifier to open and close the coarse powder outlet of a corresponding powder classifier, a coarse powder collecting container common to the plurality of power classifiers, the coarse powder collecting container being connected to the plurality of dumpers to recover coarse powder classified by each of the plurality of powder classifiers, and a controller that controls flow rates of gases supplied to the plurality of powder classifiers so that a classification point is substantially equal among the plurality of powder classifiers, wherein the plurality of dumpers open the coarse powder outlets of the plurality of powder classifiers sequentially one at a time to discharge coarse powder into the coarse powder collecting container to prohibit circulation of gases between the plurality of powder classifiers through the plurality of dumpers and the common coarse powder collecting container.

2. The powder classifying device according to claim 1, wherein each of the plurality of powder classifiers comprises:

a casing including inside thereof a substantially disk-shaped centrifuge chamber, an annular powder dispersion chamber located on one side of the centrifuge chamber, disposed concentric with the centrifuge chamber, and communicating with the centrifuge chamber, and an annular powder re-classifying chamber located on another side of the centrifuge chamber, disposed concentric with the centrifuge chamber, and communicating with the centrifuge chamber;

a plurality of guide vanes disposed so as to inwardly extend from an outer periphery of the centrifuge chamber at a given angle and adapted to cause gas to flow into the centrifuge chamber or a plurality of gas supply nozzles disposed at a given angle around the centrifuge chamber and adapted to supply gas into the centrifuge chamber; and a plurality of first nozzles that eject gas into the powder dispersion chamber to generate the whirling gas stream.

3. The powder classifying device according to claim 2, wherein each of the plurality of powder classifiers comprises a plurality of second nozzles that eject gas into the powder re-classifying chamber to generate the whirling gas stream.

4. The powder classifying device according to claim 2, wherein the controller controls flow rates of gases admitted through the guide vanes of the plurality of powder classifiers so that pressure losses in the plurality of powder classifiers are substantially equal to each other.

5. The powder classifying device according to claim 1, wherein the controller controls either of pressures and flow rates of gases supplied from the gas supply source to the plurality of powder classifiers so that pressure losses in the plurality of powder classifiers are substantially equal to each other.

6. The powder classifying device according to claim 1, wherein the powder supplier comprises a powder distributor that distributes powder to the plurality of powder classifiers.

7. The powder classifying device according to claim 1, wherein each of the plurality of powder classifiers comprises a fine powder outlet that discharges gas streams containing fine powder, and wherein the fine powder collecting section comprises a common collector connected to the fine powder outlets of the plurality of powder classifiers.

* * * * *